US007849720B2

(12) United States Patent
Reese

(10) Patent No.: US 7,849,720 B2
(45) Date of Patent: Dec. 14, 2010

(54) CAM PIN STOP APPARATUS

(75) Inventor: Mark H. Reese, Waukesha, WI (US)

(73) Assignee: Lifelong Locks, LLC, Mooresville, NC (US)

( * ) Notice: Subject to any disclaimer, the term of this patent is extended or adjusted under 35 U.S.C. 154(b) by 0 days.

(21) Appl. No.: 12/328,271

(22) Filed: Dec. 4, 2008

(65) Prior Publication Data

US 2009/0145186 A1 Jun. 11, 2009

Related U.S. Application Data

(60) Provisional application No. 61/005,468, filed on Dec. 5, 2007.

(51) Int. Cl.
*E05B 29/00* (2006.01)

(52) U.S. Cl. ..... 70/360; 70/361; 70/DIG. 20; 70/DIG. 27

(58) Field of Classification Search ..... 70/356, 70/360, 361, 365, 376, 377, DIG. 20, DIG. 27, 70/DIG. 57

See application file for complete search history.

(56) References Cited

U.S. PATENT DOCUMENTS

| | | | | |
|---|---|---|---|---|
| 2,573,061 | A * | 10/1951 | Raymond | 70/360 |
| 3,919,866 | A * | 11/1975 | Lipschutz | 70/360 |
| 3,956,912 | A * | 5/1976 | Broska | 70/360 |
| 4,611,477 | A * | 9/1986 | Crites | 70/360 |
| 4,637,234 | A * | 1/1987 | Mielonen | 70/365 |
| 5,212,972 | A * | 5/1993 | Kincaid et al. | 70/360 |
| 5,711,506 | A * | 1/1998 | Stillwagon | 70/360 |
| 5,722,275 | A * | 3/1998 | Price et al. | 70/360 |
| 6,098,434 | A * | 8/2000 | Liou | 70/360 |
| 6,564,602 | B2 | 5/2003 | Gregory | |
| 6,619,078 | B1 | 9/2003 | Reese | |
| 6,813,918 | B2 | 11/2004 | Reese | |
| 6,904,775 | B2 | 6/2005 | Makos | |
| 2007/0209415 | A1 | 9/2007 | Miao | |

FOREIGN PATENT DOCUMENTS

| | | | |
|---|---|---|---|
| EP | 0556506 | A2 | 8/1993 |
| EP | 0952050 | A2 | 10/1999 |
| JP | 55-164480 | A | 12/1980 |

OTHER PUBLICATIONS

Written Opinion of the International Searching Authority mailed Sep. 22, 2009 in connection with PCT/US08/085528.

* cited by examiner

*Primary Examiner*—Suzanne Dino Barrett
*Assistant Examiner*—Christopher Boswell
(74) *Attorney, Agent, or Firm*—McGuireWoods LLP

(57) ABSTRACT

A cam pin stop apparatus is provided which is resistant to a malicious pop-open condition. The cam pin stop apparatus includes a cam pin configured to be movable along a first axis, and a cam pin stop configured to be movable to a release location to prevent the cam pin from substantially moving along a second axis, wherein the second axis is substantially perpendicular to the first axis. A potential energy may be released by the cam pin stop when it moves to the release location.

16 Claims, 5 Drawing Sheets

CAM PIN STOP APPARATUS

CROSS REFERENCE TO PRIOR APPLICATIONS

This application claims priority and the benefit thereof from a U.S. Provisional Application No. 61/005,468, filed on Dec. 5, 2007, which is hereby incorporated by reference for all purposes as if fully set forth herein.

FIELD OF THE INVENTION

The invention generally relates to a locking system. More specifically, the invention relates to an apparatus for use with a barrel type lock system to prevent a pop-open condition, or the like.

BACKGROUND OF THE INVENTION

Locks have been in use for thousands of years, securing property from intrusion, tampering or theft. Some of the earliest locks used a pin-lock mechanism which included a wooden lock and key. The lock was strung on a rope hanging out of a hole in a door. A cylinder of wood with a hole drilled through its axis served as the key. The cylinder may be inserted into the hole to push a bolt in the door a predetermined distance to unlock the door. To lock the door, the rope may be pulled to extract the cylinder while simultaneously pulling the bolt closed.

Generally, barrel locks provide effective security against tampering or malicious unlocking. However, in certain instances, where a force is applied to the lock that is greater than the force provided by a compression spring, the lock may pop open. Thus, barrel locks may be vulnerable to a malicious pop open condition.

SUMMARY OF THE INVENTION

According to an aspect of the invention, a cam pin stop apparatus is provided which is resistant to a malicious pop-open condition. The cam pin stop apparatus comprises an outer housing, a compression spring, and a push button housing. The push button housing comprises: a locking pin configured to receive a force from the compression spring along a first axis; a cam pin configured to engage the locking pin and to be movable along a second axis, the second axis being substantially perpendicular to the first axis; a cam pin spring configured to provide a force to the cam pin along the second axis; a cam pin stop configured to be selectively movable to a release location to prevent the cam pin from substantially moving along the second axis; and a cam attached to the cam pin, wherein the cam is configured to receive a tumbler. The cam pin stop may be further configured to rotate in a plane substantially perpendicular to the first axis. The cam pin stop may be further configured to move to the release location when the cam pin is moved along the second axis to engage a cam pin opening in the outer housing. The outer housing may be further configured to lockably receive the push button housing along the first axis against a force provided by the compression spring.

According to another aspect of the invention, a cam pin stop apparatus is provided which is resistant to a malicious pop-open condition. The cam pin stop apparatus comprises: a locking pin configured to be movable along a first axis; a cam pin configured to be movable along the first axis and a second axis, which substantially perpendicular to the first axis; and a cam pin stop configured to be movable to a release location to prevent the cam pin from substantially moving along the second axis. The cam pin stop may be further configured to rotate in a plane substantially perpendicular to the first axis. The cam pin stop may be further configured to move to the release location when the cam pin is moved along the second axis to engage a cam pin opening. The cam pin stop apparatus may further comprise a cam configured to be movable along the first axis. The cam pin may be configured to be situated between the locking pin and the cam along the first axis. The cam pin stop apparatus may further comprise a tumbler. The cam pin stop apparatus may further comprise: a cam pin spring configured to provide a force to the cam pin along the second axis. The cam pin stop apparatus may further comprise: an outer housing comprising a cam pin opening, wherein the outer housing is configured to receive a compression spring and a push button housing. The push button housing may comprise: a cam configured to be movable along the first axis; a cam spring; and a tumbler. The push button housing may further comprise a key hole for receiving a key. The push button housing may further comprise a cam pin opening configured to receive a locking portion of the cam pin.

According to yet another aspect of the invention, a cam pin stop apparatus is provided which is resistant to a malicious pop-open condition. The cam pin stop apparatus comprises: a cam pin configured to be movable along a first axis; and a cam pin stop configured to be movable to a release location to prevent the cam pin from substantially moving along a second axis, wherein the second axis is substantially perpendicular to the first axis. The cam pin stop may be further configured to rotate in a plane substantially perpendicular to the first axis. The cam pin stop may be further configured to move to the release location when the cam pin is moved along the second axis to engage a cam pin opening. The cam pin may be further configured to move substantially completely from a pathway of the cam pin stop, the pathway being along the first axis. A potential energy may be released by the cam pin stop when it moves to the release location.

Additional features, advantages, and embodiments of the invention may be set forth or apparent from consideration of the detailed description and drawings. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE INVENTION

Figure 1:
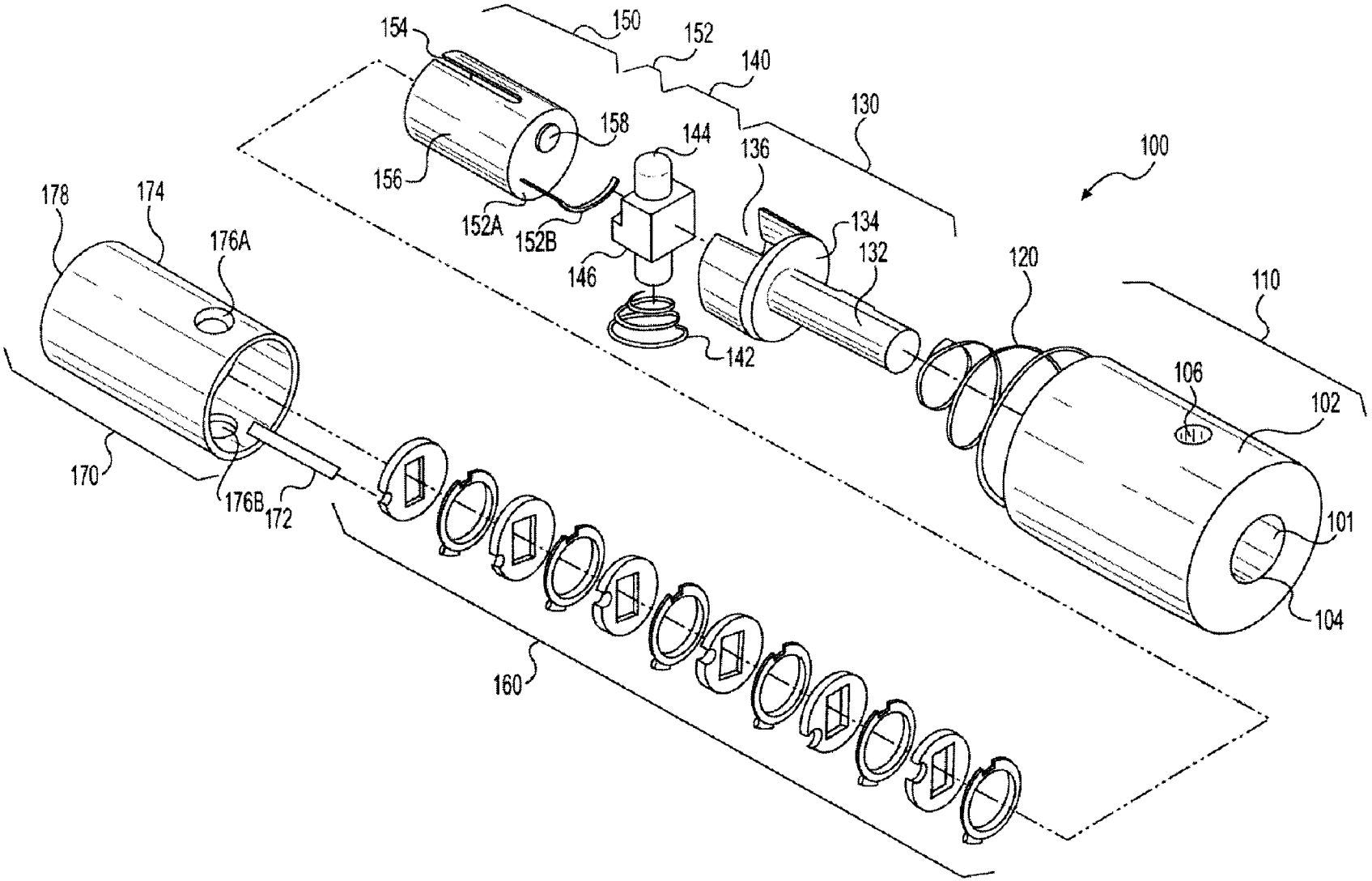
FIG. 1 shows an exploded view of an example of a cam pin stop apparatus according to an aspect of the invention.

The embodiments of the invention and the various features and advantageous details thereof are explained more fully with reference to the non-limiting embodiments and examples that are described and/or illustrated in the accompanying drawings and detailed in the following attached description. It should be noted that the features illustrated in the drawings are not necessarily drawn to scale, and features of one embodiment may be employed with other embodiments as the skilled artisan would recognize, even if not explicitly stated herein. Descriptions of well-known components and operating techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention. Moreover, it is noted that like reference numerals represent similar parts throughout the several views of the drawings.

Figure 2:
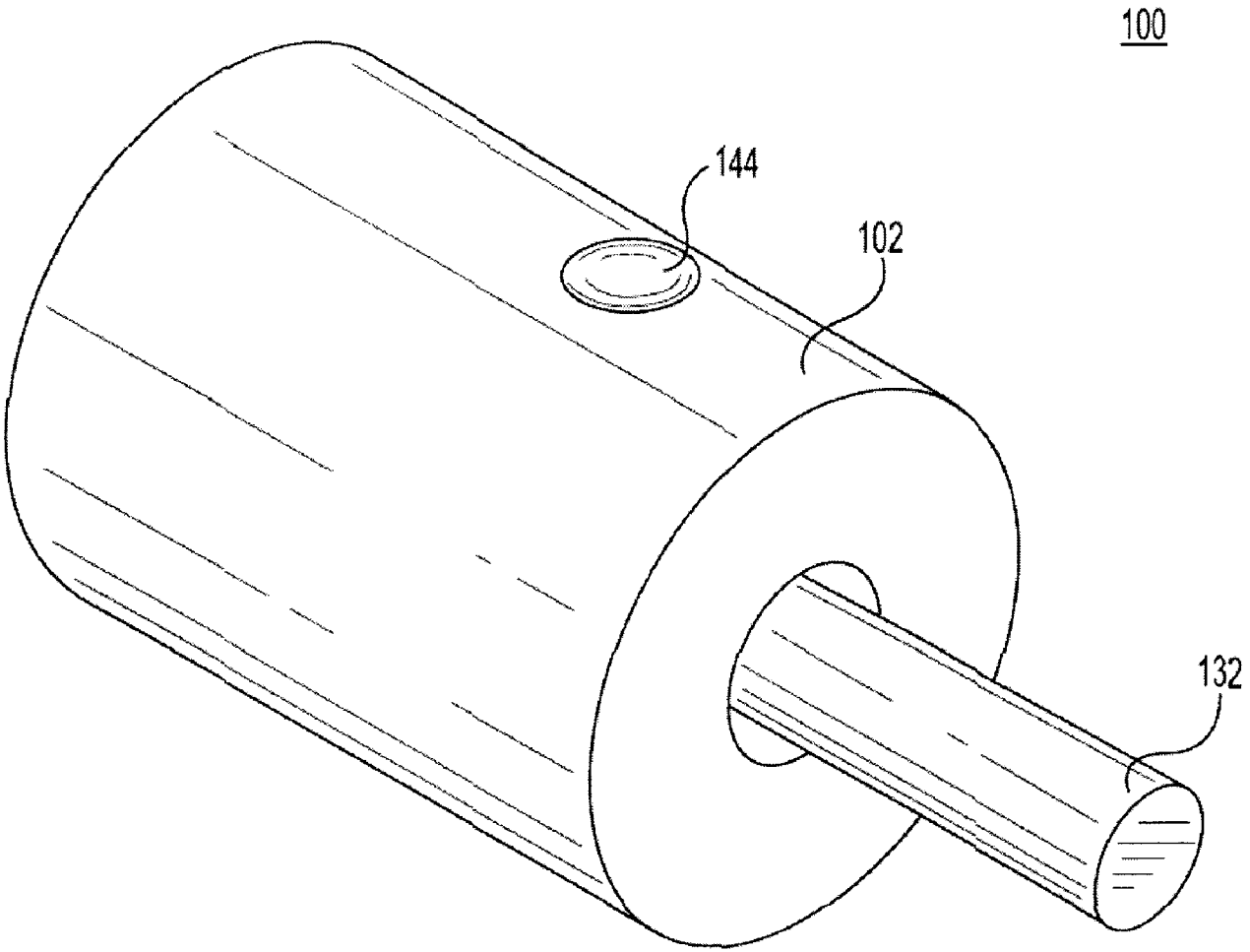
FIG. 2 shows an example of the cam pin stop apparatus of FIG. 1 in a closed or locked configuration, according to an aspect of the invention.

FIG. 1 shows an exploded view of an example of a cam pin stop (CPS) apparatus 100 according to an aspect of the invention. FIG. 2 shows an example of the cam pin stop apparatus of FIG. 1 in a closed or locked configuration, according to an aspect of the invention.

Referring to FIG. 1, the CPS apparatus 100 includes an outer housing 110, a compression spring 120, a slotted locking pin 130, a cam pin 140, a cam pin spring 142, a cam 150, a cam pin stop 152, a plurality of tumblers 160, a push button housing 170 and a tumbler set pin 172.

The outer housing 110 includes a housing body 102, a pin opening 104 and an inner surface 101. The outer housing 110 may include a cam pin opening 106, or a recess within an inner wall of the housing body 102 configured to receive the cam pin head 144. The outer housing 110 may be configured to receive the compression spring 120, the slotted locking pin 130, the cam pin 140, the cam pin spring 142, the cam 150, the cam pin stop 152, the plurality of tumblers 160, the push button housing 170 and the tumbler set pin 172, so that a button face 178 of the button housing 170 may be substantially flush with a surface edge 108 in a locked (or closed) position of the CPS apparatus 100. It is noted that the CPS apparatus 100 may be configured so that the button face 178 may be substantially recessed within the outer housing 110 or substantially protruding from the outer housing 110 in the locked position.

As seen in FIG. 1, the compression spring 120 may be configured between an inner surface 101 of the outer housing 110 and a compression surface 134 of the slotted locking pin 130. The compression spring 120 may provide a force against the inner surface 101 and the compression surface 134, such that when the CPS apparatus 100 is in an unlock state, the slotted locking pin 130 may be forced to retract (or pop) from the outer housing 110 without any need for application of force by a user. The compression spring 120 may include a conical shape, a cylindrical shape, or the like. The compression spring 120 may be constructed from a bent or coiled metal, plastic, or other material that has elastic properties. Further, compression spring 120 may include plural springs configured to provide a unitary outward force on the slotted locking pin 130.

For example, U.S. Pat. No. 6,619,078, titled "BARREL LOCK," issued Sep. 16, 2003, and U.S. Pat. No. 6,813,918, titled "BARREL LOCK ASSEMBLY," issued Nov. 9, 2004, both of which are expressly incorporated herein by reference, teach an example of a coil spring that may be used for the compression spring 120 herein.

The slotted locking pin 130 may include a slot (or opening) 136 for receiving the cam pin 140. The cam pin 140 may include a spring head 146 on a side opposite the cam pin head 144. The spring head 146 may be configured to be inserted into the cam spring 142, with one end of the cam spring 142 pressing against a surface of the cam pin 140. The cam spring 142 may include one or more springs having a conical shape, a cylindrical shape, or the like. The cam spring 142 may be constructed from a bent or coiled metal, plastic, or other material that has elastic properties. The cam pin 140 may be situated between the slotted locking pin 130 and the cam 150, as shown in FIG. 1.

The cam 150 includes a body 156 which may include a cylindrical shape, an elongated elliptical shape, or the like. The cam 150 may have a substantially smaller eccentric cylindrical protrusion on one end. The cam 150 includes a cam pin stop 152, a longitudinal recess 154 and an eccentric pin 158. The cam pin stop 152 may include a spring having ends 152A, 152B, of which the end 152A may be substantially longitudinal and attached to the cam 150 (or integrally formed with the body 156 of the cam 150) and the end 152B may be curved and unattached. The cam pin stop end 152A may include a rigid material (such as, e.g., metal, hard plastic, or the like) and the cam pin stop end 152B may include an elastic material (such as, e.g., metal, plastic, or the like). Alternatively, the cam pin stop 152 may be constructed as a single unitary structure having substantially the same material consistency throughout, including both ends 152A and 152B.

The cam 150 may be configured to receive tumblers 160 and a tumbler set pin 172. As seen in FIG. 1, the cam 150 may be situated axially adjacent the cam pin 140 and the slotted locking pin 130. The cam 150 may be activated using, for example, a key that aligns the tumblers 160 and allows the cam 150 to be rotated radially about, for example, a one-quarter (¼) turn. When the cam 150 is turned, the eccentric pin 158 engages with the cam end of the cam pin 140, overcoming the force of the cam pin spring 142 and moving the cam pin 140 to an inward or unlocked position, as shown, e.g., in FIGS. 3A and 4A. The cam 150 may be situated within the push button housing 170.

As seen in FIG. 1, the exemplary tumblers 160 may include twelve slotted rotating detainer discs. However, the number or type of tumblers 160 may not be limited to twelve tumblers or the slotted rotating detainer discs. Instead (or in addition), the tumblers 160 may include more or less than twelve tumblers and the tumblers may include, for example, tubular pins, rectangular pins, rods, or the like, as is known in the art.

The push button housing 170 may be configured to receive the tumbler set pin 172, the tumblers 160, the cam 150, the cam pin stop 152, the cam pin 140, the slotted locking pin 130 and the cam pin spring 142. Further, the push button housing 170 may be configured to be inserted into the outer housing 110. The push button housing 170 may include a keyhole in the button face 178 (for receiving a key) and one or more cam pin openings 176A, 176B in a housing body 174. Further, recesses (not shown) may be provided in the inner walls of the housing body 174, in addition to the openings 176A, 176B, to receive the cam pin head 144. The push button housing 170 may be configured as a single unit, except for the compression spring 120 and the outer housing 110, which may be provided separately.

FIGS. 3A-3G show views of various operational stages of a cross-section of the CPS apparatus 100 shown in FIG. 1; and FIGS. 4A-4G show views of various operational stages of a longitudinal-section of the CPS apparatus 100 shown in FIG. 1. As seen in FIGS. 3A-3G and 4A-4G, a cam pin stop end 152A of the cam pin stop 152 may move away from the cam pin 140 as the cam 150 is rotated radially around the axis A. Simultaneously, the other end, i.e., the cam pin stop end 152B, of the cam pin stop 152 may rotate around the axis A in the direction of the cam pin 140, while being compressed between the cam 150 and the cam pin 140 as the cam 150 is turned. The radial rotation around the axis A may continue until the cam pin head 144 is fully retracted from the cam pin opening 106 in the outer housing 110. At this point, the compression spring 120 may force the push button housing 170 (including, e.g., the slotted locking pin 130, the cam pin 140, the cam pin spring 142, the cam 150, the cam pin stop 152, the tumblers 160, the tumbler set pin 172, etc.) axially out of the outer housing 110 along the axis A until a positive stop is reached (not shown). A key (not shown) may then be turned to a locked position and removed from the CPS apparatus 100. As the key is turned around the axis A to the locked (or engaged) position, the cam 150 and the cam pin stop 152 also rotate around the axis A back to a locked (or engaged) position, with the cam pin stop 152 remaining compressed between the cam 150 and the cam pin 140 until the push button housing 170 is pushed back into the other housing 110 and the cam pin head 144 is aligned with the cam pin opening 106 in the outer housing 110. At this point, the cam pin spring 142 may push the cam pin head 144 into the cam pin opening 106, thereby allowing the cam pin stop end 152B to spring into position behind the cam pin 140 (as seen, e.g., in FIGS. 3A and 4A).

Figure 3A:
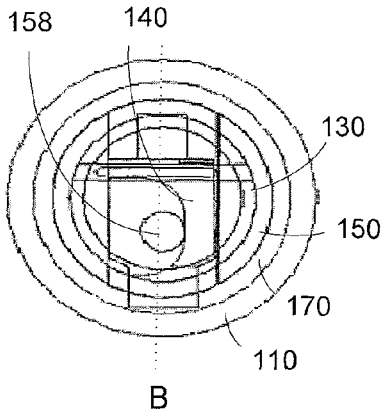
FIGS. 3A-3G show views of various operational stages of a cross-section of the cam pin stop apparatus shown in FIG. 1.
Figure 4A:
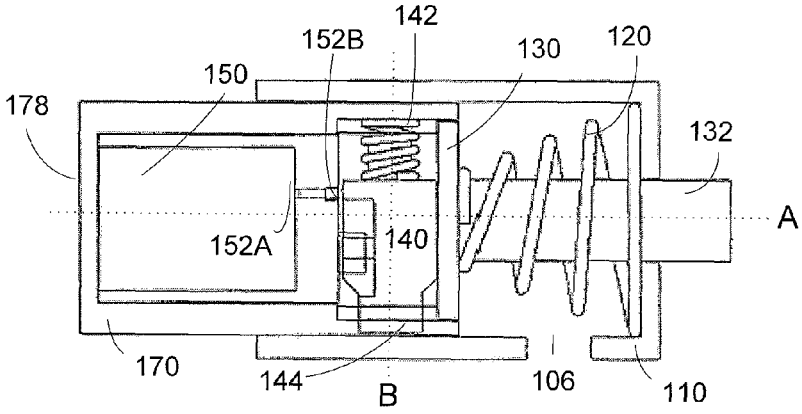
FIGS. 4A-4G show views of various operational stages of a longitudinal-section of the cam pin stop apparatus shown in FIG. 1.

FIGS. 3A and 4A show an example of the CPS apparatus 100 in a pop-open-locked (or engaged) configuration, where the key (not shown) has been turned to the locked (or engaged) position while the push button housing 170 is in the pop open position. In this configuration, the cam pin head 144 is retracted from the cam pin opening 106 and the push button housing 170 may receive an outward force from the compression spring 120 along the axis A, forcing the push button housing 170 (including, e.g., the slotted locking pin 130, the cam pin 140, the cam pin spring 142, the cam 150, the cam pin stop 152, the tumblers 160, the tumbler set pin 172, etc.) axially out of the outer housing 110 (along the axis A) against the positive stop (not shown). The positive stop may provide a force of substantially equal (or greater) magnitude, but opposite direction to the force exerted by the compression spring 120. Further, the eccentric pin 158 may be in a locked (or engaged) position to provide minimal (or substantially zero) resistance against movement of the cam pin 140 along the axis B, allowing the cam pin head 144 to be inserted (e.g., by the force from the cam spring 142) into the cam pin opening 106 when properly aligned.

As seen in FIGS. 3A and 4A, the elongated portion of the cam pin stop end 152B is positioned against a portion of a surface of the cam pin 140 along an axis that is perpendicular to both the axis A and the axis B. In this position, the cam pin stop end 152B receives a force from the surface portion of the cam pin 140 (as well as from the cam 150), thereby compressing the cam pin stop end 152B and increasing the potential energy in the cam pin stop 152. Thus, when the push button housing 170 is substantially completely pushed into the outer housing 110, the cam pin head 144 may be aligned with the cam pin opening 106 and moved along the axis B into the opening 106 by the force of the cam pin spring 142. In this regard, the movement of the cam pin 140 may release the cam pin stop end 152B, releasing the potential energy in the cam pin stop 152 and positioning the cam pin stop end 152B in a pop open prevention position (such as, for example, shown in FIGS. 3B and 4B), which prevents the cam pin 140 from maliciously caused retraction from the cam pin opening 106.

Figure 3B:
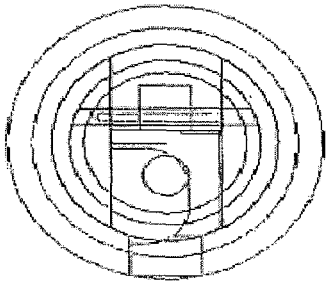
Figure 4B:
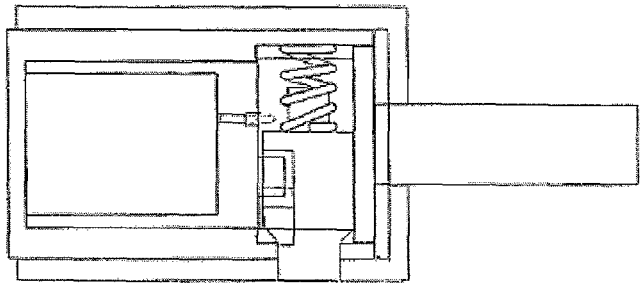
Figure 4C:
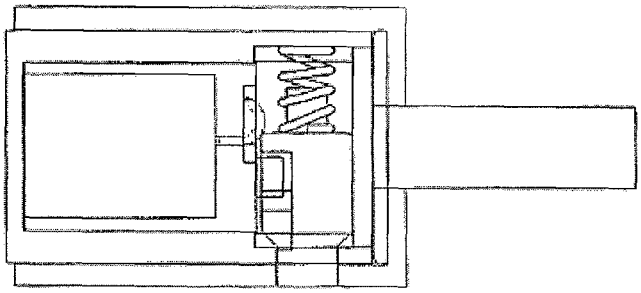
Figure 4D:
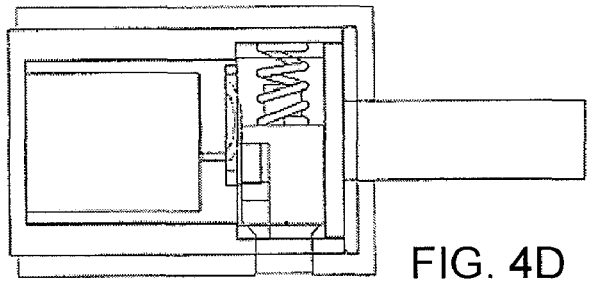
Figure 4E:
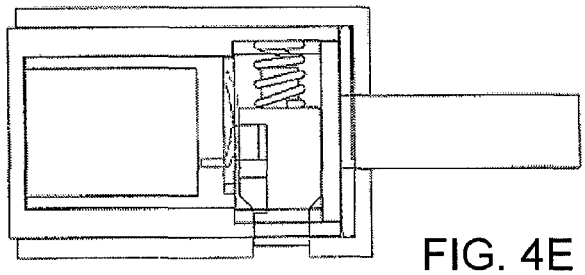

FIGS. 3B and 4B show an example of the CPS apparatus 100 in a closed-locked (or engaged) configuration, before the key (not shown) has been inserted and turned to the unlocked (or disengaged). In this configuration, the eccentric pin 158 is positioned (as shown, e.g., in FIG. 3B) to allow the cam pin spring 142 to force the cam pin head 144 to engage the cam pin hole 106 and lock the push button housing 170 in the outer housing 110. The cam pin stop end 152B is positioned along the axis B and perpendicular to the axis A, in a location (such as, e.g., shown in FIGS. 3B, 4B) that prevents the cam pin 140 from being retracted from the cam pin opening 106. It is noted that the cam pin stop end 152B release location may include a recessed portion (not shown) within the cam 140 for receiving the cam pin stop end 152B in addition to, or instead of the release location shown, e.g., in FIGS. 3B, 4B.

Alternatively, FIGS. 3B and 4B may show an example of the CPS apparatus 100 substantially immediately after the push button 170 in the exemplary configuration shown in FIGS. 3A and 4A has been substantially completely pushed into the outer housing 110 and the cam pin head 144, aligned and engaged with the cam pin opening 106.

Figure 3C:
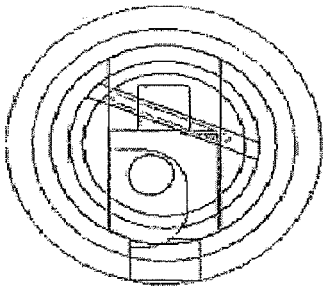
Figure 3D:
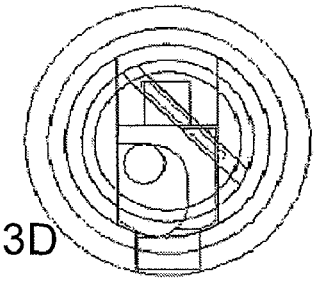
Figure 3E:
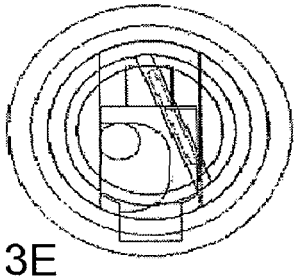
Figure 3F:
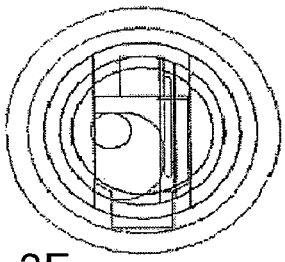
Figure 4F:
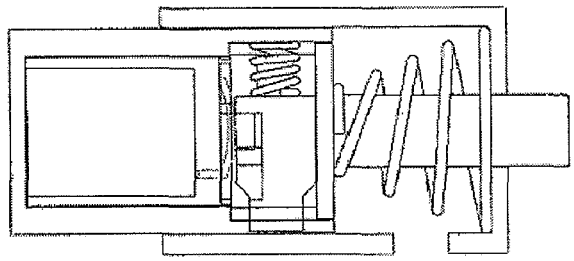

Referring to FIGS. 3C-3F and 4C-4F, after the key is inserted and rotated to an unlocked (or disengaged) position, the eccentric pin 158 is also moved to the unlocked position, providing a force greater than the force provided by the cam spring 142, thereby moving the cam pin 140 to the retracted position shown in FIGS. 3F, 4F. Simultaneously, the cam pin stop end 152A is also turned to the unlocked position, where the cam pin stop end 152B is positioned along the axis B, but perpendicular to the axis A, as shown in FIGS. 3F, 4F. As the cam pin stop end 152A is turned and the cam pin 140 is retracted, a surface of the cam pin 140 which is substantially parallel to the axis B contacts and compresses the cam pin stop end 152B, thereby increasing a potential energy in the cam pin stop 152. When the cam pin head 144 has been substantially completely retracted from the cam pin opening 106 and the cam pin stop end 152B is moved to the open position (where it is positioned along the axis B), the push button housing 170 may be popped open by a force of the compression spring 120, as shown in FIGS. 3F, 4F. In this position, the cam pin stop end 152B may continue to receive a force from the surface of the cam pin 140 (as well as from the cam 150), maintaining the cam pin stop end 152B in a compressed configuration and maintaining the potential energy in the cam pin stop 152.

FIGS. 3F and 4F show an example of the CPS apparatus 100 in a pop-open-unlocked (or disengaged) configuration, where the key (not shown) has been inserted and turned to the unlocked (or disengaged).

Figure 3G:
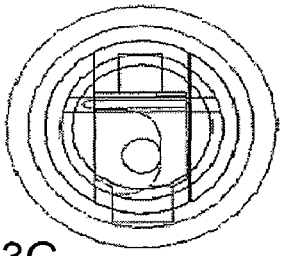
Figure 4G:
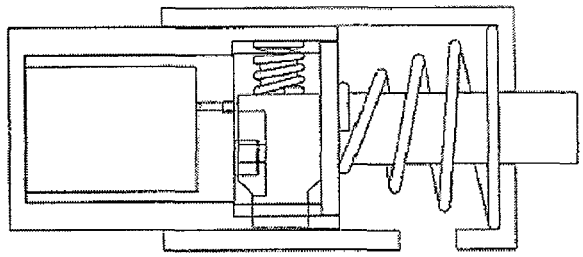

As the key is turned from the unlocked position shown in FIGS. 3F, 4F to the locked position, the eccentric pin 158 and the cam pin stop 152 are both moved to the locked position shown in FIGS. 3G, 4G, discussed above with reference to FIGS. 3A, 4A. In this position, the cam pin stop end 152B continues to receive a force from the surface of the cam pin 140 (as well as from the cam 150), maintaining the cam pin stop end 152B in a compressed configuration and maintaining the potential energy in the cam pin stop 152. Thus, when the push button housing 170 is substantially completely pushed into the outer housing 110 and the cam pin head 144 aligns with the cam pin opening 106, the cam pin 140 may engage with the cam pin opening 106 and lock the push button housing 170 in the closed (or locked) configuration (such as, e.g., shown in FIGS. 3B and 4B). Simultaneously, the cam pin stop end 152B may be released to the release location shown in FIGS. 3B, 4B to securely keep the cam pin head 144 from being maliciously retracted from the cam pin opening 106. As noted earlier, the cam pin stop end 152B release location may include a recessed portion (not shown) within the cam 140 for receiving the cam pin stop end 152B in addition to, or instead of the release location shown, e.g., in FIGS. 3B, 4B.

Figure 5:
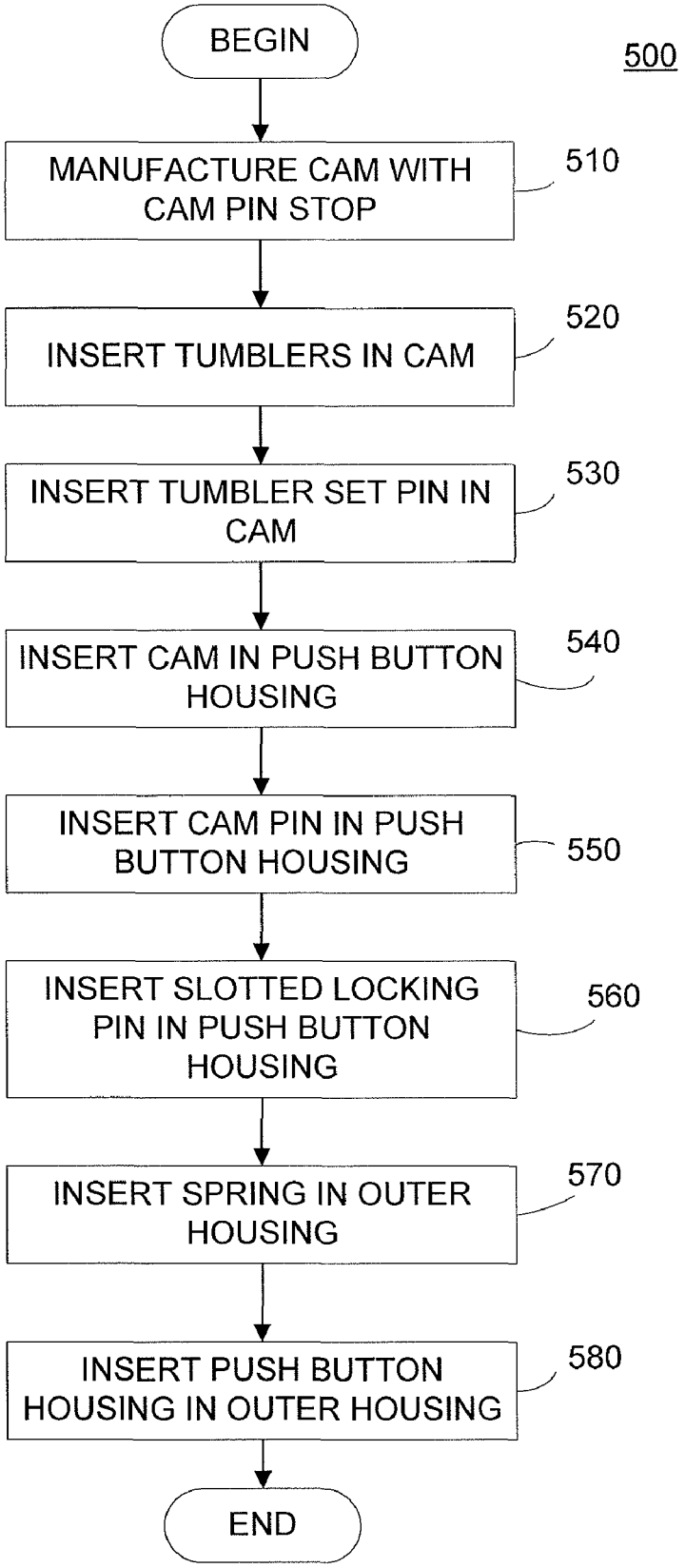
FIG. 5 shows an example of a process for manufacturing and assembling the cam pin stop apparatus of FIG. 1, according to an aspect of the invention.

FIG. 5 shows an example of a process for manufacturing and assembling the cam pin stop apparatus of FIG. 1, according to an aspect of the invention.

Referring to FIGS. 1 and 5, initially, a cam 150 may be manufactured or constructed with a cam pin stop 152 (Step 510). The cam pin stop 152 may be attached to the cam 150 by a screw, pin, or the like, or through a process such as, for example, but not limited to, welding, gluing, or the like. Alternatively, the cam pin stop 152 may be integrally manufactured with the cam 150.

After the cam 150 has been manufactured with the cam pin stop 152, one or more tumblers 160 may be inserted into the cam 150 (Step 520), as well as a tumbler set pin 172 (Step 530). The cam 150, including the one or more tumblers 160 and cam pin stop 152, may then be inserted into a push button housing 170 capable of wholly receiving the cam 150 (Step 540). A cam pin 140 may then be inserted into the push button housing 170 adjacent the cam 150 (Step 550). A slotted locking pin may then be inserted into the push button housing adjacent the cam pin 140 (Step 560) to create a push button housing assembly. A compression spring, such as, for example, a conical compression spring, or the like, may then be inserted into an outer housing (Step 570). The push button housing assembly may then be inserted into the outer housing, against the compression spring (Step 580).

It is noted that the sequence of Steps 510 to 580 in process 500 may be reconfigured without departing from the scope or spirit of the invention. For example, the tumbler set pin 172 may be inserted into the cam 150 (Step 530) before the tumblers 160 are inserted in the cam 150 (Step 520).

Further, a computer readable medium is provided that includes a computer program which when executed on a general purpose computer causes Steps 510 to 580 to be carried out. The computer program may include a code section or segment for the each of the Steps 510 to 580 of the process 500.

While the invention has been described in terms of exemplary embodiments, those skilled in the art will recognize that the invention can be practiced with modifications in the spirit and scope of the appended claims. These examples are merely illustrative and are not meant to be an exhaustive list of all possible designs, embodiments, applications or modifications of the invention.

What is claimed:

1. A lock comprising:

an outer housing;

a compression spring;

a push button housing;

a locking pin configured to receive a force from the compression spring along a first axis;

a cam pin configured to engage the locking pin and to be movable along a second axis, the second axis being substantially perpendicular to the first axis;

a cam pin spring configured to provide a force to the cam pin in a first direction along the second axis; and a cam configured to rotate between a locked position and an unlocked position with respect to the first axis and selectively engage the cam pin, the cam comprising:

an eccentric pin protruding from a circular end surface of the cam and configured to move the cam pin in a second direction along the second axis when the cam rotates from the locked position, the second direction being opposite to the first direction; and an elastic cam pin stop extending from the circular end surface of the cam and configured to prevent the cam pin from substantially moving in the second direction along the second axis when the cam is in the locked position, wherein the eccentric pin is configured not to provide a force to the cam pin in the first direction along the second axis when the cam rotates from the unlocked position to the locked position, wherein the elastic cam pin stop is a spring comprising:

a first end connected to the circular end surface of the cam;

a second end; and a body portion extending between the first end and the second end.

2. The lock according to claim 1, wherein the elastic cam pin stop is further configured to rotate in a plane substantially perpendicular to the first axis.

3. The lock according to claim 2, wherein the elastic cam pin stop is further configured to engage the cam pin when the cam pin is moved by the cam pin spring in the first direction along the second axis to engage a cam pin opening in the outer housing.

4. The lock according to claim 1, wherein the outer housing is configured to lockably receive the push button housing along the first axis against a force provided by the compression spring.

5. The lock of claim 1, wherein the second end of the spring is unattached and the body portion of the spring is curved.

6. The lock of claim 1, wherein the first end of the spring comprises a rigid material and the second end of the spring comprises an elastic material.

7. A lock comprising:

a locking pin configured to be movable along a first axis;

a cam pin configured to be movable along a second axis substantially perpendicular to the first axis;

a cam pin spring configured to provide a force to the cam pin in a first direction along the second axis; and a cam configured to rotate between a locked position and an unlocked position with respect to the first axis and selectively engage the cam pin, the cam comprising:

an eccentric pin protruding from a circular end surface of the cam and configured to move the cam pin in a second direction along the second axis when the cam rotates from the locked position, the second direction being opposite to the first direction; and an elastic cam pin stop extending from the circular end surface of the cam and configured to prevent the cam pin from substantially moving in the second direction along the second axis when the cam is in the locked position, the cam pin stop comprising a spring connected to the circular end surface of the cam, wherein the eccentric pin is configured not to provide a force to the cam pin in the first direction along the second axis when the cam rotates from the unlocked position to the locked position, wherein the elastic cam pin stop is a spring comprising:

a first end connected to the circular end surface of the cam;

a second end; and a body portion extending between the first end and the second end.

8. The lock according to claim 7, wherein the elastic cam pin stop is further configured to rotate in a plane substantially perpendicular to the first axis.

9. The lock according to claim 8, wherein the elastic cam pin stop is further configured to engage the cam pin when the cam pin is moved by the cam pin spring in the first direction along the second axis to engage a cam pin opening.

10. The lock according to claim 7, wherein the cam pin is configured to be situated between the locking pin and the cam along the first axis.

11. The lock according to claim 7, further comprising:

at least one tumbler.

12. The lock according to claim 11, further comprising:

an outer housing comprising a cam pin opening, wherein the outer housing is configured to receive a compression spring and a push button housing.

13. The lock according to claim 12, wherein the cam, the cam spring and the at least one tumbler are arranged in the push button housing.

14. The lock according to claim 13, wherein the push button housing further comprises:

a key hole for receiving a key.

15. The lock according to claim 13, wherein the push button housing further comprises:

a cam pin opening configured to receive a locking portion of the cam pin.

16. The lock of claim 7, wherein the second end of the spring is unattached and the body portion of the spring is curved.

* * * * *